US008147654B2

(12) United States Patent
Sawada et al.

(10) Patent No.: US 8,147,654 B2
(45) Date of Patent: Apr. 3, 2012

(54) WET PAPER WEB TRANSFER BELT

(75) Inventors: Takeshi Sawada, Tokyo (JP); Kenji Inoue, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 372 days.

(21) Appl. No.: 12/446,645

(22) PCT Filed: Oct. 26, 2007

(86) PCT No.: PCT/JP2007/070891

§ 371 (c)(1),
(2), (4) Date: Apr. 22, 2009

(87) PCT Pub. No.: WO2008/053797

PCT Pub. Date: May 8, 2008

(65) Prior Publication Data

US 2010/0043996 A1 Feb. 25, 2010

(30) Foreign Application Priority Data

Nov. 1, 2006 (JP) ..... 2006-298318
Jan. 20, 2007 (JP) ..... 2007-010896

(51) Int. Cl.

| | |
|---|---|
| ***D21F 7/08*** | (2006.01) |
| ***D21F 2/00*** | (2006.01) |
| ***B32B 27/06*** | (2006.01) |
| ***B32B 5/02*** | (2006.01) |

(52) U.S. Cl. ..... 162/358.2; 162/306; 162/900; 442/275; 442/281; 442/274; 442/243

(58) Field of Classification Search ..... 162/306, 162/358.1, 358.2, 358.4, 900–903; 442/118, 442/76, 218, 220, 226, 227, 242, 243, 271, 442/274, 275, 277, 281
See application file for complete search history.

(56) References Cited

U.S. PATENT DOCUMENTS

| | | | | |
|---|---|---|---|---|
| 4,461,803 | A * | 7/1984 | Booth et al. | 442/206 |
| 5,328,757 | A | 7/1994 | Kenney | |
| 5,829,488 | A | 11/1998 | Fagerholm | |
| 7,455,752 | B2 * | 11/2008 | Hansen | 162/358.2 |
| 2004/0185729 | A1 * | 9/2004 | Inoue | 442/118 |

FOREIGN PATENT DOCUMENTS

| | | | |
|---|---|---|---|
| JP | 2001-89990 | A1 | 4/2001 |
| JP | 2004-277971 | A1 | 10/2004 |
| WO | WO 99/05358 | A1 | 2/1999 |

OTHER PUBLICATIONS

International Search Report for International Application No. PCT/JP2007/070891 dated Dec. 17, 2007.

* cited by examiner

*Primary Examiner* — Eric Hug
(74) *Attorney, Agent, or Firm* — Kratz, Quintos & Hanson, LLP

(57) ABSTRACT

A wet paper web transfer belt (1) has a wet paper web-side layer (31), including a hydrophilic fibrous body (30), and a machine-side layer (32). A base fabric (33) disposed in the belt comprises a first woven fabric (34), disposed on a wet paper web (W) side, and a second woven fabric (35) disposed on a press roll (10) side, and the first woven fabric (34) and the second woven fabric (35) are stacked together. A portion of the hydrophilic fibrous body (30) is exposed on a surface (37) of the wet paper web-side layer (31). The first woven fabric (34) and the second woven fabric (35) include weft yarns (36) made of a material of low water absorptivity. When the hydrophilic fibrous body (30) is formed in the wet paper web-side layer (31) of the belt (1) by needle punching, an increase in the widthwise dimension of the belt due to the absorption of water by the hydrophilic fibrous body (30) is reduced.

12 Claims, 8 Drawing Sheets

WET PAPER WEB TRANSFER BELT

TECHNICAL FIELD

The present invention relates to a wet paper web transfer belt for transferring a wet paper web at a high speed in a closed-draw-type papermaking machine.

BACKGROUND ART

Papermaking machines for dewatering the paper material include a wire part, a press part and a drier part. The wire part, the press part and the drier part are arranged in the order named along the direction in which the wet paper web is transferred.

Some papermaking machines are of the type which transfers the wet paper web in open draws. The open-draw papermaking machines do not support the wet paper web with belts. As a result, the wet paper web tends to be broken in a region in which it is transferred from one section to another. Accordingly, the open-draw papermaking machines are difficult to operate at higher speeds.

In recent years, papermaking machines which are of the type for transferring the wet paper web in closed draws are prevalent in the art. The closed-draw papermaking machines have a belt for transferring the wet paper web. The wet paper web is placed on the belt and transferred by the belt from one section to another. As a result, the closed-draw papermaking machines can operate at higher speeds and more stably.

In the closed-draw papermaking machines, the wet paper web is transferred by being transferred successively through the wire part, the press part and the drier part. In the press part, the wet paper web is transferred by the transfer belt, and pressed by a press to squeeze water out. Thereafter, the wet paper web is dried in the drier part.

The present applicant has proposed, in Japanese published patent application No. 2004-277971, a wet paper web transfer belt which has a first function to cause the wet paper web to stick thereto and transfer the wet paper web and a second function to allow the wet paper web to be smoothly released therefrom for transferring the wet paper web to a next process. The wet paper web transfer belt includes a wet paper web-side layer comprising a high-polymer elastic region and a fibrous body. The fibrous body is hydrophilic and partly exposed on the surface of the wet paper web-side layer.

As the hydrophilic fibrous body, which is exposed on the surface of the wet paper web-side layer, retains the water from the wet paper web, it performs the first function to cause the wet paper web to stick thereto and transfer the wet paper web. The portion of the fibrous body, which is exposed on the surface of the wet paper web-side layer, performs the second function to allow the wet paper web to be smoothly released therefrom for transferring the wet paper web to a next process.

Patent document 1: Japanese published patent application No. 2004-277971

The wet paper web transfer belt disclosed in Japanese published patent application No. 2004-277971 has both of the above two functions balanced. However, when part of the water contained in the wet paper web is absorbed by the hydrophilic fibrous body (e.g., rayon fibers) of the wet paper web-side layer, the fibrous body expands, making the wet paper web transfer belt dimensionally unstable. In recent years, particularly since the wet paper web transfer belt is required to travel at increased speeds, it is necessary to reduce an increase in the widthwise dimension of the belt which is caused by the absorption of water by the hydrophilic fibrous body.

The present invention has been made to solve the above problems. In order to improve the first function to cause the wet paper web to stick thereto and transfer the wet paper web and the second function to allow the wet paper web to be smoothly released therefrom for transferring the wet paper web to a next process, the hydrophilic fibrous body is formed in the wet paper web-side layer of the wet paper web transfer belt by needle punching. It is an object of the present invention to provide a wet paper web transfer belt which is capable of reducing an increase in the widthwise dimension of the belt which is caused by the absorption of water by a hydrophilic fibrous body.

DISCLOSURE OF THE INVENTION

The inventor of the present invention has recognized the problem that the widthwise dimension of the belt is increased by the absorption of water by a hydrophilic fibrous body (made of rayon fibers, for example) included in a wet paper web-side layer of a wet paper web transfer belt. The invention has completed the present invention for reducing such an increase in the widthwise dimension of the belt.

To achieve the above object, a wet paper web transfer belt according to the present invention serves to transfer a wet paper web in a closed-draw papermaking machine, and the wet paper web transfer belt has a wet paper web-side layer including a hydrophilic fibrous body and disposed on a wet paper web side and a machine-side layer disposed on a press roll side, and a base fabric is disposed therein.

The base fabric comprises a first woven fabric disposed on the wet paper web side and a second woven fabric disposed on the press roll side. The first woven fabric and the second woven fabric are stacked together. At least a portion of the hydrophilic fibrous body is exposed on a surface of the wet paper web-side layer. Either one or both of the first woven fabric and the second woven fabric include weft yarns made of a material of low water absorptivity.

The weft yarns of the woven fabrics used in the present invention should preferably be made of a material selected from the group consisting of polyester, aromatic polyamide, aromatic polyester and polyether ketone.

According to a preferred embodiment, the basis weight of the first woven fabric is smaller than the basis weight of the second woven fabric. For example, the first woven fabric is of a plain weave and the second woven fabric is of a double weave. According to another example, the first woven fabric is of a double weave and the second woven fabric is of a triple weave. According to still another example, the first woven fabric may be of a plain weave and the second woven fabric may be of a triple weave.

Preferably, in the wet paper web transfer belt, the hydrophilic fibrous body is formed in the wet paper web-side layer by needle punching to improve a first function and a second function. The first function is a function to cause the wet paper web to stick to the belt and to transfer the wet paper web. The second function is a function to allow the wet paper web to be smoothly released therefrom for transferring the wet paper web to a next process.

The wet paper web-side layer includes a wet paper web-side batt layer made up of the hydrophilic fibrous body, so that the wet paper web-side batt layer has high water absorbability. The wet paper web-side batt layer should preferably be impregnated with a high-polymer elastic body.

The high-polymer elastic body is made of a thermosetting resin selected from the group consisting of urethane, epoxy and acrylic, or made of a thermoplastic resin selected from the group consisting of polyamide, polyarylate and polyester, for example.

The hydrophilic fibrous body is made of fibers selected from the group of hydrophilic fibers of nylon, vinylon, acetate, rayon, polynosic, cupra, cotton, hemp, silk and wool, for example.

Preferably, a wet paper web-side batt layer of the wet paper web-side layer and a machine-side batt layer of the machine-side layer are made of rayon fibers or nylon fibers, and the hydrophilic fibrous body included in the wet paper web-side layer is made of fibers having surfaces chemically hydrophilized by a mercerizing process, a resinating process, a sputtering process based on the application of an ionizing radiation, or a glow discharge process.

Preferably, the official moisture regain of a fibrous body used as a machine-side batt layer of the machine-side layer is lower than the official moisture regain of the hydrophilic fibrous body as a wet paper web-side batt layer of the wet paper web-side layer by 4% or more.

The fibrous body used as a machine-side batt layer is made of fibers selected from the group consisting of fibers of vinylidene, polyvinyl chloride, polyethylene, polypropylene, polyester, aromatic polyamide, polyurethane and acrylic, for example.

The wet paper web transfer belt according to the present invention is constructed as described above. In order to improve the first function to cause the wet paper web to stick thereto and transfer the wet paper web, and the second function to allow the wet paper web to be smoothly released therefrom for transferring the wet paper web to a next process, the hydrophilic fibrous body is formed in the wet paper web-side layer of the wet paper web transfer belt by needle punching. The present invention is thus capable of reducing an increase in the widthwise dimension of the belt due to the absorption of water by the hydrophilic fibrous body.

BRIEF DESCRIPTION OF THE DRAWINGS

FIG. 1 is a schematic view of a closed-draw papermaking machine which employs a wet paper web transfer belt according to the present invention;

FIG. 2 is a cross-sectional view of a wet paper web transfer belt according to a first embodiment of the present invention;

FIG. 3 is a cross-sectional view of a wet paper web transfer belt according to a second embodiment of the present invention;

FIG. 4 is a cross-sectional view of a wet paper web transfer belt according to a third embodiment of the present invention;

FIG. 5 is a plan view of the wet paper web transfer belts;

FIG. 6 is a schematic view of an experimental apparatus for evaluating the performance of wet paper web transfer belts;

FIG. 7 is a view showing the manner in which the wet paper web transfer belt according to the present invention is manufactured by a needle machine; and FIG. 8 is a view showing the manner in which a wet paper web transfer belt according to comparative example 4 is manufactured by a needle machine.

BEST MODE FOR CARRYING OUT THE INVENTION

Wet paper web transfer belts according to the present invention will be described below.

Figure 1:
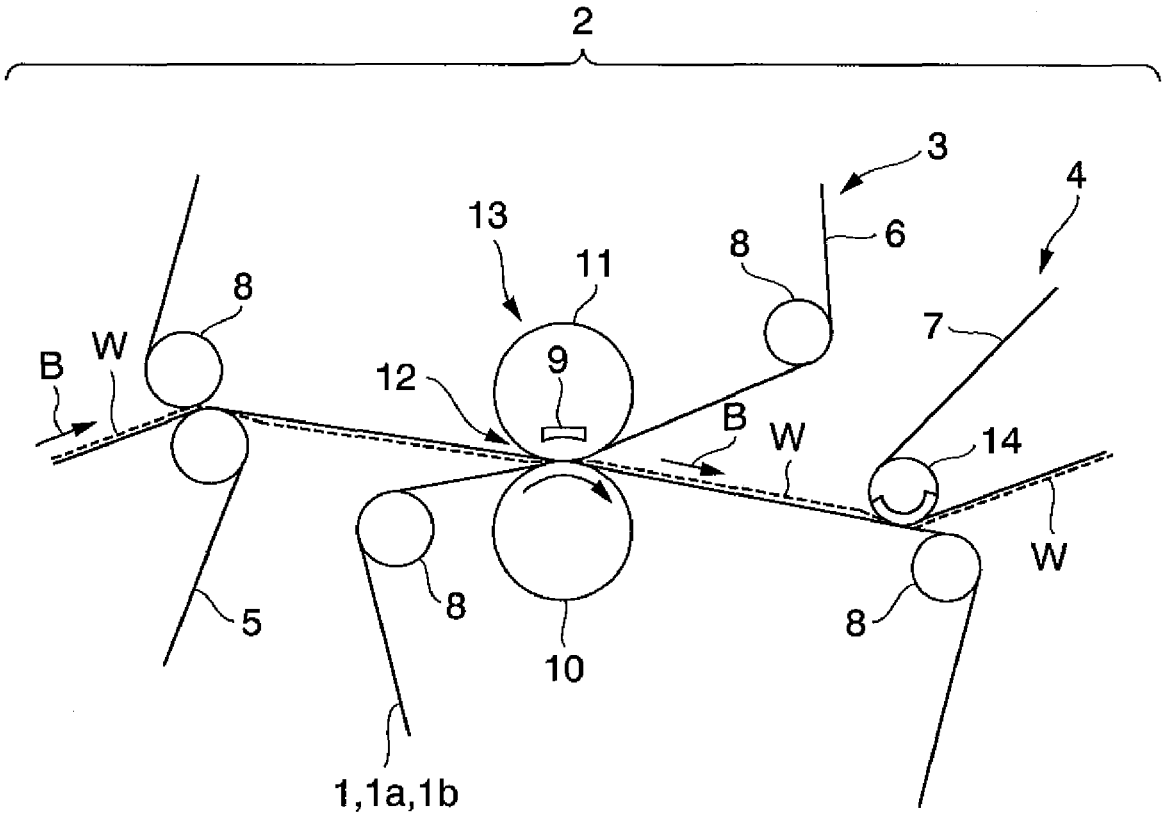
FIGS. 1 through 8 are views which are illustrative of the present invention.

FIGS. 1 through 8 are views which are illustrative of the present invention. FIG. 1 is a schematic view of a closed-draw papermaking machine which employs a wet paper web transfer belt according to the present invention;

As shown in FIG. 1, a closed-draw papermaking machine (hereinafter referred to as "papermaking machine") 2 for dewatering the paper material comprises a wire part (not shown), a press part 3 and a drier part 4. The wire part, the press part 3 and the drier part 4 are arranged in the order named along the direction in which a wet paper web W is transferred (the direction indicated by the arrow B).

The wet paper web W is transferred by being transferred successively through the wire part, the press part 3 and the drier part 4. After water is squeezed out of the wet paper web W in the press part 3, the wet paper web W is finally dried in the drier part 4. A wet paper web transfer belt 1 (hereinafter referred to as "belt 1") is disposed in the press part 3 and is used to transfer the wet paper web W in the direction indicated by the arrow B.

The wet paper web W is supported by press felts 5, 6, the belt 1 and a drier fabric 7 and is transferred in the direction indicated by the arrow B. Each of the press felts 5, 6, the belt 1 and the drier fabric 7 is in the form of an endless belt which is supported by guide rollers 8.

A shoe 9 is of a concave shape complementary to a press roll 10. The shoe 9 and the press roll 10 with a shoe press belt 11 interposed therebetween make up a press region 12.

A shoe press mechanism 13 has the press roll 10 and the shoe 9 which is disposed upwardly (or downwardly) of the press roll 10. The shoe press belt 11 is disposed between the press roll 10 and the shoe 9 and travels while in rotation. A plurality of shoe press mechanisms 13 are disposed in a linear array along the direction in which the wet paper web W is transferred (the direction indicated by the arrow B), thereby providing the press part 3 of the papermaking machine 2.

After the wet paper web W is transferred from the wire part (not shown) to the press part 3, it is transferred from the press felt 5 to the press felt 6. The wet paper web W is then transferred to the press region 12 of the shoe press mechanism 13 by the press felt 6.

In the press region 12, the wet paper web W, as it is sandwiched between the press felt 6 and the belt 1, is pressed by the shoe 9 and the press roll 10 with the shoe press belt 11 interposed therebetween. As a result, water in the wet paper web W is squeezed out.

The press felt 6 is highly permeable to water, and the belt 1 is of low water permeability. Therefore, water in the wet paper web W moves to the press felt 6 in the press region 12. In this manner, the wet paper web W is dewatered and has its surface smoothed in the press part 3.

Immediately after the wet paper web W leaves the press region 12, the wet paper web W, the press felt 6 and the belt 1 have their volumes expanded because they are quickly released from the pressure. Due to their expansion and the capillary action of the pulp fibers, a so-called "remoisturization phenomenon" occurs in which part of the water in the press felt 6 moves to the wet paper web W.

Since the belt 1 is of low water permeability, it retains little water therein. Therefore, any remoisturization phenomenon in which water moves from the belt 1 to the wet paper web W does not essentially take place. The belt 1 thus contributes to an increase in the smoothness of the wet paper web W.

The wet paper web W which has passed through the press region 12 is transferred by the belt 1 in the direction indicated by the arrow B. Then, the wet paper web W is attracted by a suction roll 14, and is transferred by the drier fabric 7 to the drier part 4 in which the wet paper web W is dried.

The belt 1 is required to have a first function to positively cause the wet paper web W to stick to the surface of the belt 1 immediately after the wet paper web W leaves the press region 12. The belt 1 is also required to have a second function to release the wet paper web W smoothly from the belt 1 when the belt 1 transfers the wet paper web W to the next process (the drier part 4).

Belts 1, 1*a*, 1*b* will be described below.

Figure 2:
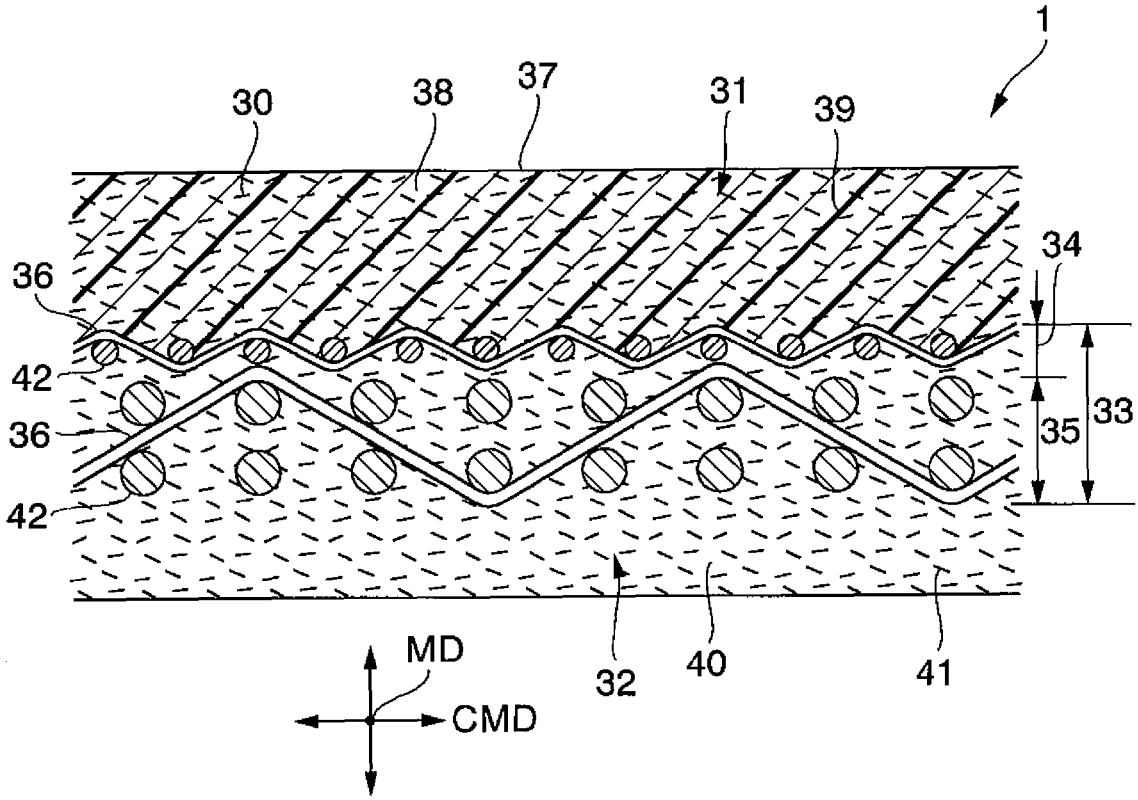
Figure 3:
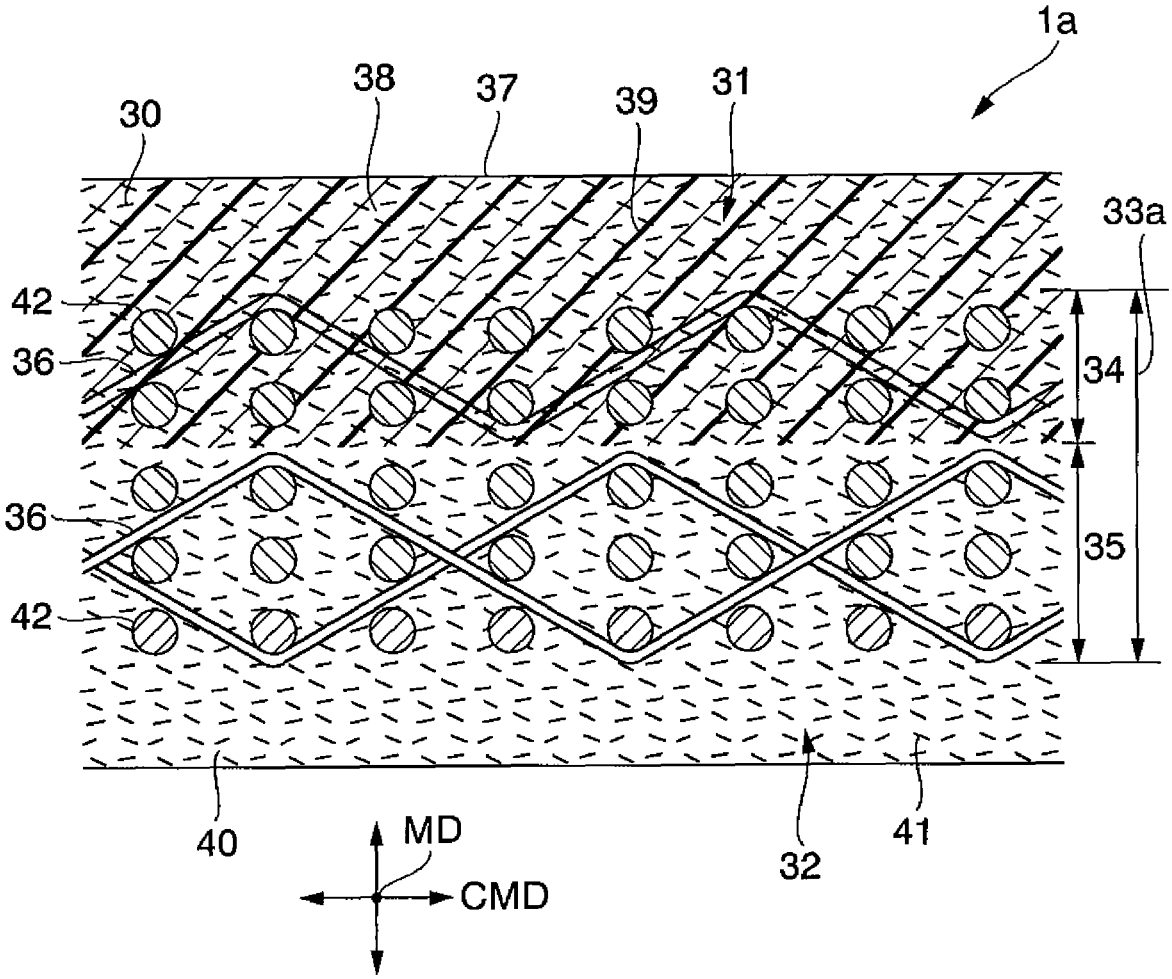
Figure 4:
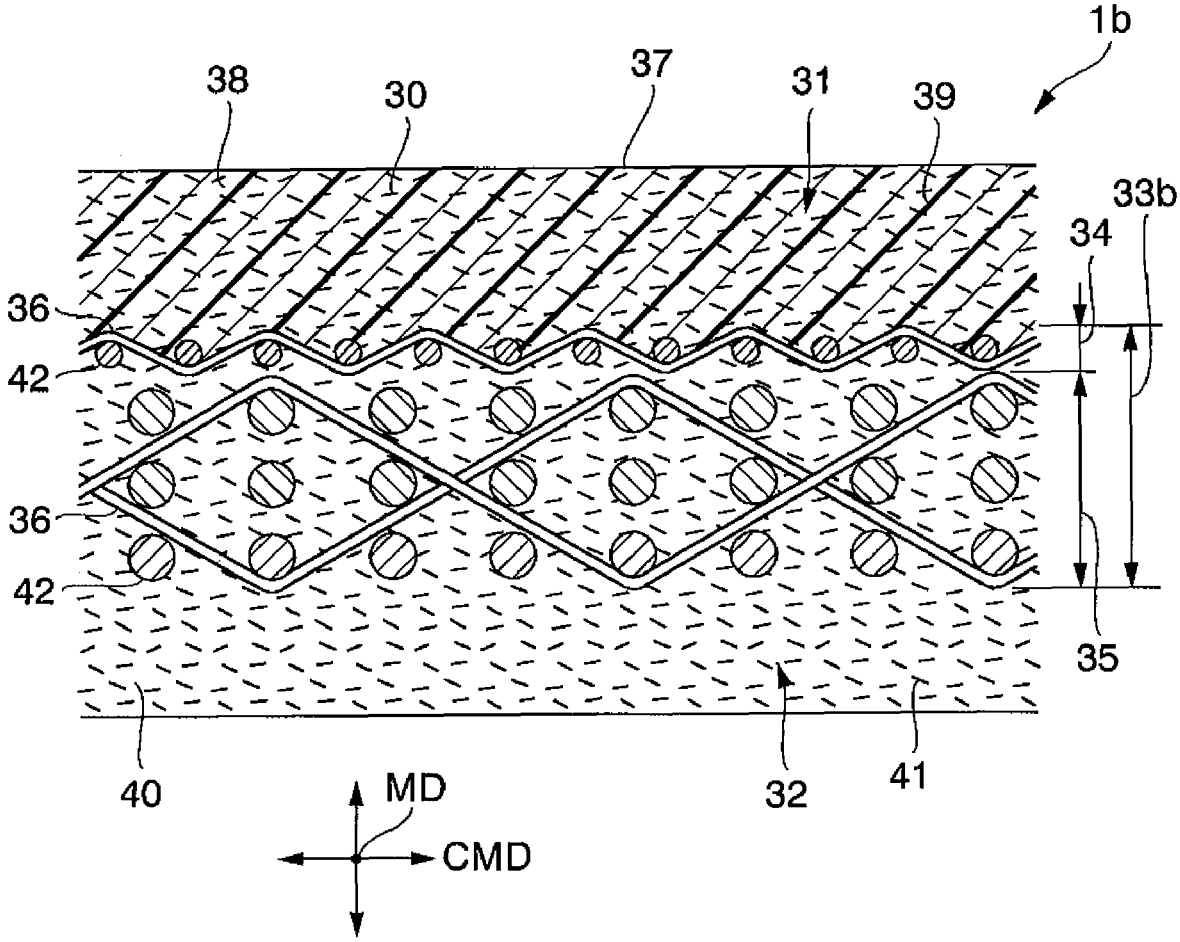
Figure 5:
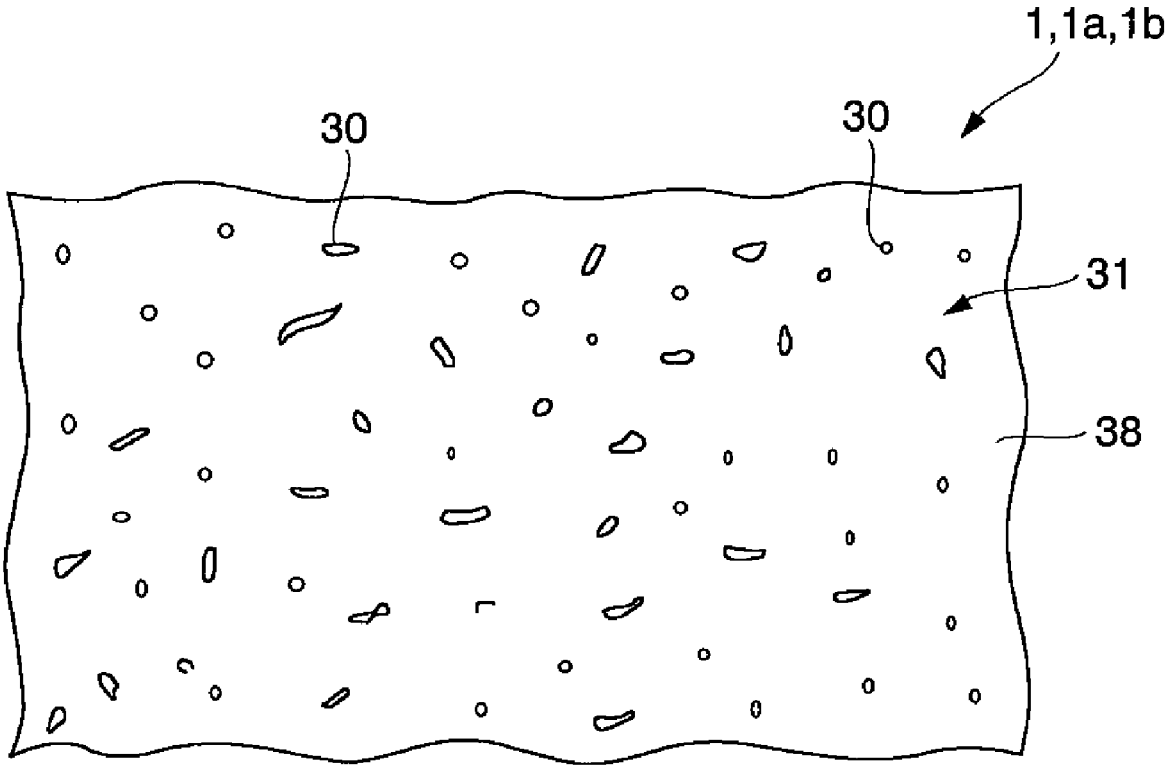

FIG. 2 is a cross-sectional view of a belt 1 according to a first embodiment of the present invention. FIG. 3 is a cross-sectional view of a wet paper web transfer belt 1*a* (hereinafter referred to as "belt 1*a*") according to a second embodiment of the present invention, and FIG. 3 corresponds to FIG. 2. FIG. 4 is a cross-sectional view of a wet paper web transfer belt 1*b* (hereinafter referred to as "belt 1*b*") according to a third embodiment of the present invention, and FIG. 4 corresponds to FIG. 2. FIG. 5 is a plan view of the belts 1, 1*a* and 1*b*.

In FIGS. 1 through 5, the belts 1, 1*a*, 1*b* have a dimension in a predetermined widthwise direction (CMD direction), and travels in a warpwise direction (MD direction) with the wet paper web W placed on an upper surface thereof.

The belts 1, 1*a*, 1*b* have a wet paper web-side layer 31, including a hydrophilic fibrous body 30 and disposed on the wet paper web W side, and a machine-side layer 32 disposed on the press roll 10 side. The belts 1, 1*a*, 1*b* include respective base fabrics 33, 33*a*, 33*b* disposed therein. The belts 1, 1*a*, 1*b* are of a laminar structure in their entirety with the wet paper web-side layer 31 and the machine-side layer 32 disposed one on each side of the substrates 33, 33*a*, 33*b*.

The hydrophilic property of the hydrophilic fibrous body 30 refers to a property to attract water and/or a property to retain water. According to the present invention, the hydrophilic property is represented by "official moisture regain" specified in JIS L0105 (general principles of physical testing methods for textiles).

The base fabrics 33, 33*a*, 33*b* are constructed of a first woven fabric 34, disposed on the wet paper web W side, and a second woven fabric 35 disposed on the press roll 10 side. The first woven fabric 34 and the second woven fabric 35 are stacked together. At least a portion of the hydrophilic fibrous body 30 is exposed on a surface 37 of the wet paper web-side layer 31. The term "exposed" refers to a state in which the hydrophilic fibrous body 30 appears on the surface 37 of the wet paper web-side layer 31, irrespectively of whether the hydrophilic fibrous body 30 projects outwardly from the surface 37 of the wet paper web-side layer or not. FIG. 5 shows an example of the state in which the hydrophilic fibrous body 30 is exposed on the surface 37 of the wet paper web-side layer 31, though the invention should not be limited to the illustrated state.

Either one or both of the first woven fabric 34 and the second woven fabric 35 include weft yarns 36 made of a material of low water absorptivity.

In order to improve the first function and the second function, the hydrophilic fibrous body 30 is formed in the wet paper web-side layer 31 of the belts 1, 1*a*, 1*b* by needle punching. The first function is a function to cause the wet paper web W to stick to the belts 1, 1*a*, 1*b* and to transfer the wet paper web W. The second function is a function to allow the wet paper web W to be smoothly released from the belts 1, 1*a*, 1*b* for transferring the wet paper web W to a next process.

The belts 1, 1*a*, 1*b* according to the present invention are capable of reducing the increases in the widthwise dimension thereof due to the absorption of water by the hydrophilic fibrous body 30.

The wet paper web-side layer 31 includes a wet paper web-side batt layer 38 made up of the hydrophilic fibrous body 30. Therefore, the wet paper web-side batt layer 38 is of high water absorbability. The wet paper web-side batt layer 38 is impregnated with a high-polymer elastic body 39, and the portion of the hydrophilic fibrous body 30 is exposed on the surface 37 of the wet paper web-side layer 31.

The high-polymer elastic body 39 may be made of a thermosetting resin such as urethane, epoxy, acrylic, or the like or a thermoplastic resin such as polyamide, polyarylate, polyester, or the like.

The belts 1, 1*a*, 1*b* should preferably be impermeable to air. However, depending on the papermaking machine 2, the belts 1, 1*a*, 1*b* may slightly be permeable to air. The belts 1, 1*a*, 1*b* may have desired air permeability if the amount of the impregnated high-polymer elastic body 39 is reduced, the surface 37 of the wet paper web-side layer 31 is polished, or the high-polymer elastic body contains interconnected pores.

The wet paper web-side batt layer 38 of the wet paper web-side layer 31 and a machine-side batt layer 40 of the machine-side layer 32 are made of staple fibers. The hydrophilic fibrous body 30 is used as the staple fibers of the wet paper web-side batt layer 38. Fibers which have lower official moisture regain than the hydrophilic fibrous body 30 are used as the staple fibers of the machine-side batt layer 40.

The wet paper web-side batt layer 38 is intertwiningly integrated with the wet paper web side of the base fabrics 33, 33*a*, 33*b* by needle punching. The machine-side batt layer 40 is intertwiningly integrated with the machine side (press roll 10 side) of base fabrics 33, 33*a*, 33*b*. A means for integrating the wet paper web-side batt layer 38 and the machine-side batt layer 40 may be adhesive bonding, electrostatic flocking or the like as well as needle punching.

The hydrophilic fibrous body 30 should preferably have an official moisture regain of 4% or more. Specifically, the fibers of the hydrophilic fibrous body 30 are selected from the group of hydrophilic fibers made of nylon (official moisture regain of 4.5%), vinylon (official moisture regain of 5.0%), acetate (official moisture regain of 6.5%), rayon (official moisture regain of 11.0%), polynosic (official moisture regain of 11.0%), cupra (official moisture regain of 11.0%), cotton (official moisture regain of 8.5%), hemp (official moisture regain of 12.0%), silk (official moisture regain of 12.0%) and wool (official moisture regain of 15.0%), etc. The numerical values in the parentheses represent official moisture regains.

If fibers having an official moisture regain of less than 4% are used, then since they cannot sufficiently retain the water from the wet paper web W, they fail to sufficiently perform the first function to cause the wet paper web W to stick to the belts 1, 1*a*, 1*b* and to transfer the wet paper web W.

According to inventive examples and comparative examples to be described later, the wet paper web-side batt layer 38 and the machine-side batt layer 40 are made of rayon fibers or nylon fibers.

The hydrophilic fibrous body 30 may be made of fibers having surfaces chemically hydrophilized. Specifically, the surfaces of the fibers may be treated by a mercerizing process, a resinating process, a sputtering process based on the application of an ionizing radiation, a glow discharge process, or the like.

The hydrophilizing process can exhibit good results if the contact angle with water is 30 degrees or less while the moisture of hydrophilized monofilaments or spun yarns is adjusted to a value in the range from 30 to 50%. The percentage of the moisture of the monofilaments or spun yarns is calculated by the equation: (water/overall weight)×100.

After the wet paper web-side batt layer 38 is impregnated with the high-polymer elastic body 39 and is cured, the surface of the wet paper web-side batt layer 38 is ground by sandpaper or a grinding stone. To prevent the fibers of the hydrophilic fibrous body 30 from being fibrilized when the surface of the wet paper web-side batt layer 38 is ground, it is desirable for the hydrophilic fibrous body 30 to have a strength of 0.8 g/dtex or more.

As a result, at least the portion of the hydrophilic fibrous body 30 is exposed on the surface 37 of the wet paper web-side layer 31. Consequently, when the belts 1, 1*a*, 1*b* transfer the wet paper web W to a next process, the belts 1, 1*a*, 1*b* perform the second function to smoothly release the wet paper web W therefrom.

The machine-side batt layer 40 comprises a fibrous body 41 made of fibers which are less hydrophilic, or of a lower official moisture regain, than the hydrophilic fibrous body 30 of the wet paper web-side batt layer 38. Specifically, the fibrous body 41 may be made of fibers whose official moisture regain is different from the official moisture regain of the hydrophilic fibrous body 30 by 4% or more.

Alternatively, the fibers of the fibrous body 41 may be selected from the group of fibers made of vinylidene (official moisture regain of 0%), polyvinyl chloride (official moisture regain of 0%), polyethylene (official moisture regain of 0%), polypropylene (official moisture regain of 0%), polyester (official moisture regain of 0.4%), aromatic polyamide (official moisture regain of 0.4%), polyurethane (official moisture regain of 1.0%) and acrylic (official moisture regain of 2.0%), etc. which are of low official moisture regains.

Since the machine-side batt layer 40 is held in contact with the press roll 10, the machine-side batt layer 40 may be made chiefly of nylon fibers which are of excellent wear resistance and other fibers mixed therewith.

The wet paper web-side batt layer 38 of the wet paper web-side layer 31 should preferably have a basis weight in the range from 50 to 600 g/m$^2$. The machine-side batt layer 40 of the machine-side layer 32 should preferably have a basis weight in the range from 0 to 600 g/m$^2$.

The base fabrics 33, 33*a*, 33*b* comprise the first woven fabric 34 and the second woven fabric 35 which are stacked together. The first woven fabric 34 and the second woven fabric 35 are produced by weaving warp yarns 42 in the MD direction and the weft yarns 36 in the CMD direction.

The weft yarns 36 of either one or both of the first woven fabric 34 and the second woven fabric 35 are made of a material selected from the group consisting of polyester, aromatic polyamide, aromatic polyester and polyether ketone which are of low water absorbability. With the weft yarns 36 being made of such a material, it is possible to reduce an increase in the widthwise dimension of the belt due to the absorption of water by the hydrophilic fibrous body 30 of the wet paper web-side batt layer 38.

The first woven fabric 34 and the second woven fabric 35 have a structure which is either one of a plain weave, a double weave and a triple weave as described below. The basis weight of the first woven fabric 34 is smaller than the basis weight of the second woven fabric 35.

The belts 1, 1*a*, 1*b* are manufactured by a needle machine. The first woven fabric 34 and the second woven fabric 35 are stacked together into the base fabrics 33, 33*a*, 33*b*. Then, while the base fabrics 33, 33*a*, 33*b* which are of the stacked-layer structure are being transported along guide rolls of the needle machine, the wet paper web-side batt layer 38 is needle-punched. At this time, since the lower fabric (the second woven fabric 35) is held in contact with the guide rolls, the upper fabric (the first woven fabric 34) needs to be elongated to match an increase in the dimension of the lower fabric.

Inasmuch as the basis weight of the upper fabric (the first woven fabric 34) is smaller than the basis weight of the lower fabric (the second woven fabric 35), as described above, the upper fabric with the lower basis weight is more liable to elongate than the lower fabric. As a consequence, the warpwise dimensions of the upper fabric and the lower fabric (the first woven fabric 34 and the second woven fabric 35) can be brought into conformity with each other. Since such a "dimensional match" can be achieved by the present invention, it is possible to produce the base fabrics 33, 33*a*, 33*b* which have a good structure in which the first woven fabric 34 and the second woven fabric 35 are free of warpwise positional displacements.

For making the basis weight of the first woven fabric 34 smaller than the basis weight of the second woven fabric 35 in the base fabric 33, the belt 1 (FIG. 2) according to one case includes the upper fabric (the first woven fabric 34), which is of a plain weave, and the lower fabric (the second woven fabric 35) which is of a double weave.

According to another case, the belt 1*a* (FIG. 3) includes the upper fabric (the first woven fabric 34), which is of a double weave, and the lower fabric (the second woven fabric 35) which is of a triple weave. According to still another case, the belt 1*b* (FIG. 4) includes the upper fabric (the first woven fabric 34), which is of a plain weave, and the lower fabric (the second woven fabric 35) which is of a triple weave.

Embodiments

Figure 6:
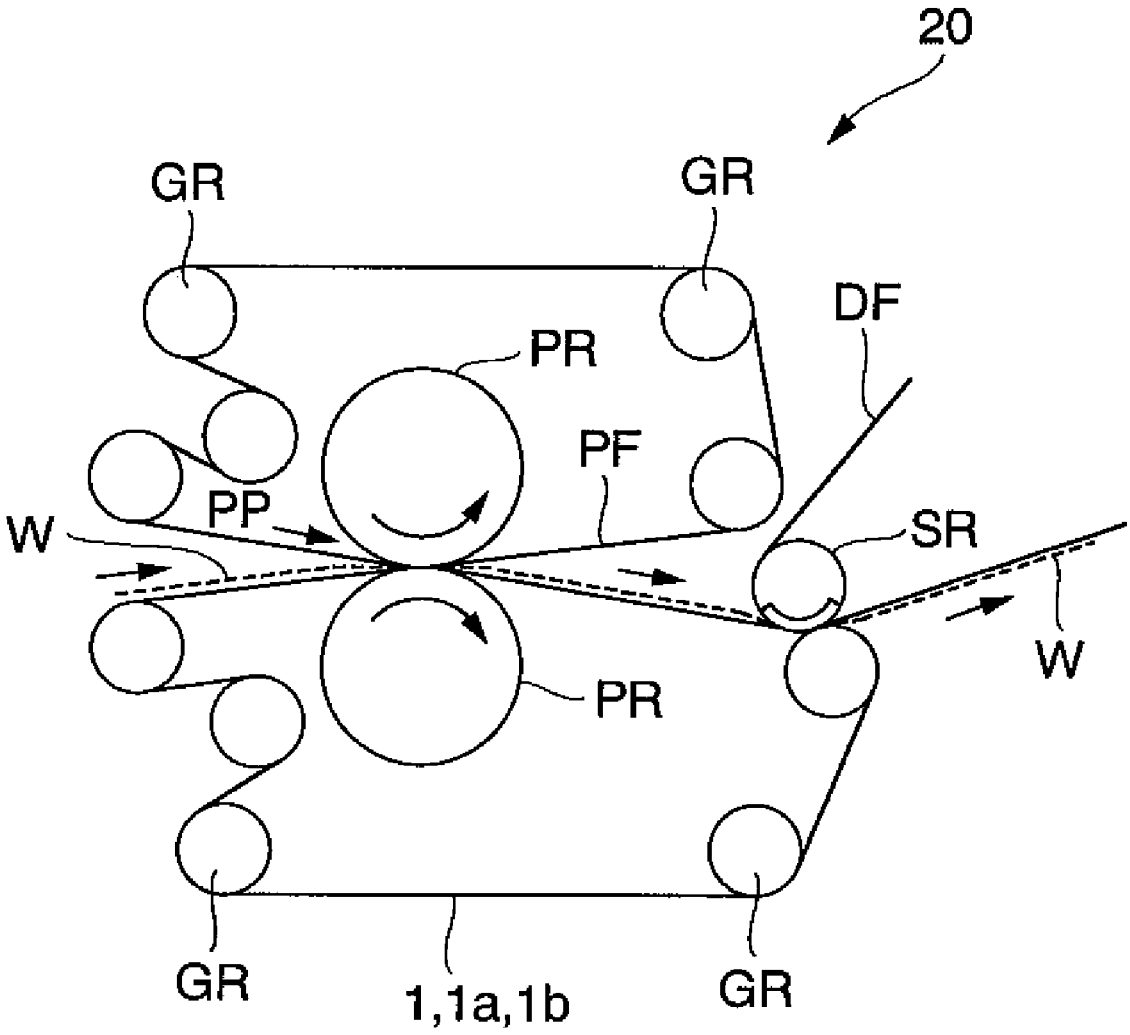

Experiments were conducted on specific inventive examples 1 through 3 and comparative examples 1 through 3 by an experimental apparatus 20. FIG. 6 is a schematic view of the experimental apparatus 20 for evaluating the performance of wet paper web transfer belts.

The experimental apparatus 20 comprises a pair of press rolls PR, PR providing a press region PP, a press felt PF pinched between the press rolls PR, PR, and a belt 1, 1*a*, 1*b*.

The press felt PF and the belt 1, 1*a*, 1*b* are supported under constant tension by a plurality of guide rollers GR. The press felt PF and the belt 1, 1*a*, 1*b* are driven to travel as the press rolls PR rotate. A drier fabric DF is of an endless structure as with the press felt PF and the belt 1, 1*a*, 1*b*, and travels while being supported by guide rollers.

In the experimental apparatus 20, a wet paper web W is placed on the belt 1, 1*a*, 1*b* which is positioned upstream of the press region PR The wet paper web W is transported by the belt 1, 1*a*, 1*b* to pass through the press region PP, and thereafter reaches a suction roll SR. The wet paper web W is attracted by the suction roll SR and transferred to the drier fabric DF.

Details of the base fabrics 33, 33*a*, 33*b*:

(A) Structure and basis weight:

1. Plain weave . . . basis weight 100 through 400 (g/m$^2$)
2. Double weave . . . basis weight 400 through 700 (g/m$^2$)
3. Triple weave . . . basis weight 500 through 900 (g/m$^2$)

(B) Yarn material (warp yarns 42 and weft yarns 36)

1. Monofilament and multifilament
2. Monofilament spun yarn

3. Multifilament spun yarn
4. Monofilament and multifilament combined spun yarn (C) Material of yarns (warp yarns 42 and weft yarns 36)

1. Nylon
2. Polyester (particularly, polyethylene terephthalate (PET)
3. Aromatic polyamide
4. Aromatic polyester
5. Polyether ketone (D) Stacked-layer structure of base fabrics (upper fabric/lower fabric)

1. Plain weave/double weave . . . (see FIG. 2)
2. Double weave/triple weave . . . (see FIG. 3)
3. Plain weave/triple weave . . . (see FIG. 4)

In these base fabrics, the basis weight of the upper fabric is smaller than the basis weight of the lower fabric.

Inventive Example 1

1. Base Fabric 33:

The upper fabric (the first woven fabric 34) was of a 1/1 plain weave structure (the warp yarns 42 comprised nylon multifilament spun yarns and the weft yarns 36 comprised PET single yarns), and had a basis weight of 200 g/m$^2$.

The lower fabric (the second woven fabric 35) was of a warp double weave structure (the warp yarns 42 comprised nylon monofilament spun yarns and the weft yarns 36 comprised nylon monofilament spun yarns), and had a basis weight of 400 g/m$^2$.

2. Batt Layer:

The wet paper web-side batt layer 38 was formed of rayon fibers of the hydrophilic fibrous body 30 by needle punching, and had a basis weight of 600 g/m$^2$. The machine-side batt layer 40 was formed of nylon fibers by needle punching, and had a basis weight of 250 g/m$^2$.

3. Impregnation of High-Polymer Elastic Body 39:

The wet paper web batt layer of the needle-punched felt was impregnated with a urethane resin at a rate of 500 g/m$^2$.

4. Dimensional Changes Caused by Experimental Apparatus 20:

The dimensions (in the traveling direction and the widthwise direction) of the wet paper web transfer belt immediately after the experimentation started were indicated by 100, and the belt dimensions were measured after 100 hours from the experimentation to evaluate changes in the belt dimensions.

Dimensional changes after the experimentation:

Traveling direction (elongated 1.2%), widthwise direction (elongated 1.0%)

Inventive Example 2

1. Base Fabric 33*a:*

The upper fabric (the first woven fabric 34) was of a warp double weave structure (the warp yarns comprised nylon monofilament spun yarns and the weft yarns comprised nylon single yarns), and had a basis weight of 400 g/m$^2$.

The lower fabric (the second woven fabric 35) was of a warp triple weave structure (the warp yarns comprised nylon monofilament spun yarns and the weft yarns comprised PET single yarns), and had a basis weight of 600 g/m$^2$.

2. Batt Layer: Same as Inventive Example 1.

3. Impregnation of High-Polymer Elastic Body 39: Same as Inventive Example 1.

4. Dimensional Changes Caused by Experimental Apparatus:

Dimensional changes after the experimentation: Traveling direction (elongated 1.2%), widthwise direction (elongated 0.6%)

Inventive Example 3

1. Base Fabric 33*b:*

The upper fabric (the first woven fabric 34) was of a 1/1 plain weave structure (the warp yarns comprised nylon multifilament spun yarns and the weft yarns comprised PET single yarns), and had a basis weight of 200 g/m$^2$.

The lower fabric (the second woven fabric 35) was of a warp triple weave structure (the warp yarns comprised nylon monofilament spun yarns and the weft yarns comprised PET single yarns), and had a basis weight of 600 g/m$^2$.

2. Batt Layer: Same as Inventive Example 1.

3. Impregnation of High-Polymer Elastic Body 39: Same as Inventive Example 1.

4. Dimensional Changes Caused by Experimental Apparatus:

Dimensional changes after the experimentation: Traveling direction (elongated 1.2%), widthwise direction (elongated 0.4%)

Comparative Example 1

1. Base Fabric:

The upper fabric (the wet paper web-side woven fabric) was of a 1/1 plain weave structure (the warp yarns comprised nylon multifilament spun yarns and the weft yarns comprised nylon single yarns), and had a basis weight of 200 g/m$^2$.

The lower fabric (the roll-side woven fabric) was of a warp double weave structure (the warp yarns comprised nylon monofilament spun yarns and the weft yarns comprised nylon monofilament spun yarns), and had a basis weight of 400 g/m$^2$.

2. Batt Layer: Same as Inventive Example 1.

3. Impregnation of High-Polymer Elastic Body: Same as Inventive Example 1.

4. Dimensional Changes Caused by Experimental Apparatus:

Dimensional changes after the experimentation: Traveling direction (elongated 1.2%), widthwise direction (elongated 2.0%)

Comparative Example 2

1. Base Fabric:

The upper fabric (the wet paper web-side woven fabric) was of a warp triple weave structure (the warp yarns comprised nylon monofilament spun yarns and the weft yarns comprised nylon monofilament spun yarns), and had a basis weight of 600 g/m$^2$.

No lower fabric was used.

2. Batt Layer: Same as Inventive Example 1.

3. Impregnation of High-Polymer Elastic Body: Same as Inventive Example 1.

4. Dimensional Changes Caused by Experimental Apparatus:

Dimensional changes after the experimentation: Traveling direction (elongated 1.2%), widthwise direction (elongated 2.5%)

Comparative Example 3

1. Base Fabric:

The upper fabric (the wet paper web-side woven fabric) was of a 1/1 plain weave structure (the warp yarns comprised nylon multifilament spun yarns and the weft yarns comprised nylon single yarns), and had a basis weight of 200 g/m$^2$.

The lower fabric (the roll-side woven fabric) was of a warp double weave structure (the warp yarns comprised nylon monofilament spun yarns and the weft yarns comprised nylon monofilament spun yarns), and had a basis weight of 400 g/m$^2$.

2. Batt Layer:

The wet paper web-side batt layer was formed of nylon fibers by needle punching, and had a basis weight of 600 g/m$^2$. The roll-side batt layer was formed of nylon fibers by needle punching, and had a basis weight of 250 g/m$^2$.

3. Impregnation of High-Polymer Elastic Body: Same as Inventive Example 1.

4. Dimensional Changes Caused by Experimental Apparatus:

Dimensional changes after the experimentation: Traveling direction (elongated 1.0%), widthwise direction (elongated 0.5%)

In the experiments using the experimental apparatus 20, the belts 1, 1*a*, 1*b* incorporating the base fabrics 33, 33*a*, 33*b* according to inventive examples 1 through 3 and the wet paper web transfer belts according to comparative examples 1 through 3 were compared with each other.

As a result, the belts 1, 1*a*, 1*b* which include rayon fibers of the hydrophilic fibrous body in the wet paper web-side batt layer are capable of reducing increases in the widthwise dimension thereof due to the absorption of water by the hydrophilic fibrous body.

Specifically, the widthwise dimension of the wet paper web transfer belts according to comparative examples 1 through 3 was increased by 0.5 to 2.5%. The widthwise dimension of the belts 1, 1*a*, 1*b* was increased by 0.4 to 1.0%. It is thus understood that the increases in the widthwise dimension of the belts 1, 1*a*, 1*b* are reduced.

It was found from the experimentation that the wet paper web transfer belt according to comparative example 3 had insufficient functions as a wet paper web transfer belt though it had good widthwise dimensional stability. Specifically, the first function to cause the wet paper web W to stick to the wet paper web transfer belt and transfer the wet paper web W, and the second function allow the wet paper web W to be smoothly released from the belt for transferring the wet paper web W to a next process were insufficient.

It was also found from the experimentation that the belts 1, 1*a*, 1*b* according to inventive examples 1 through 3 well performed the first function and the second functions referred to above.

Figure 7:
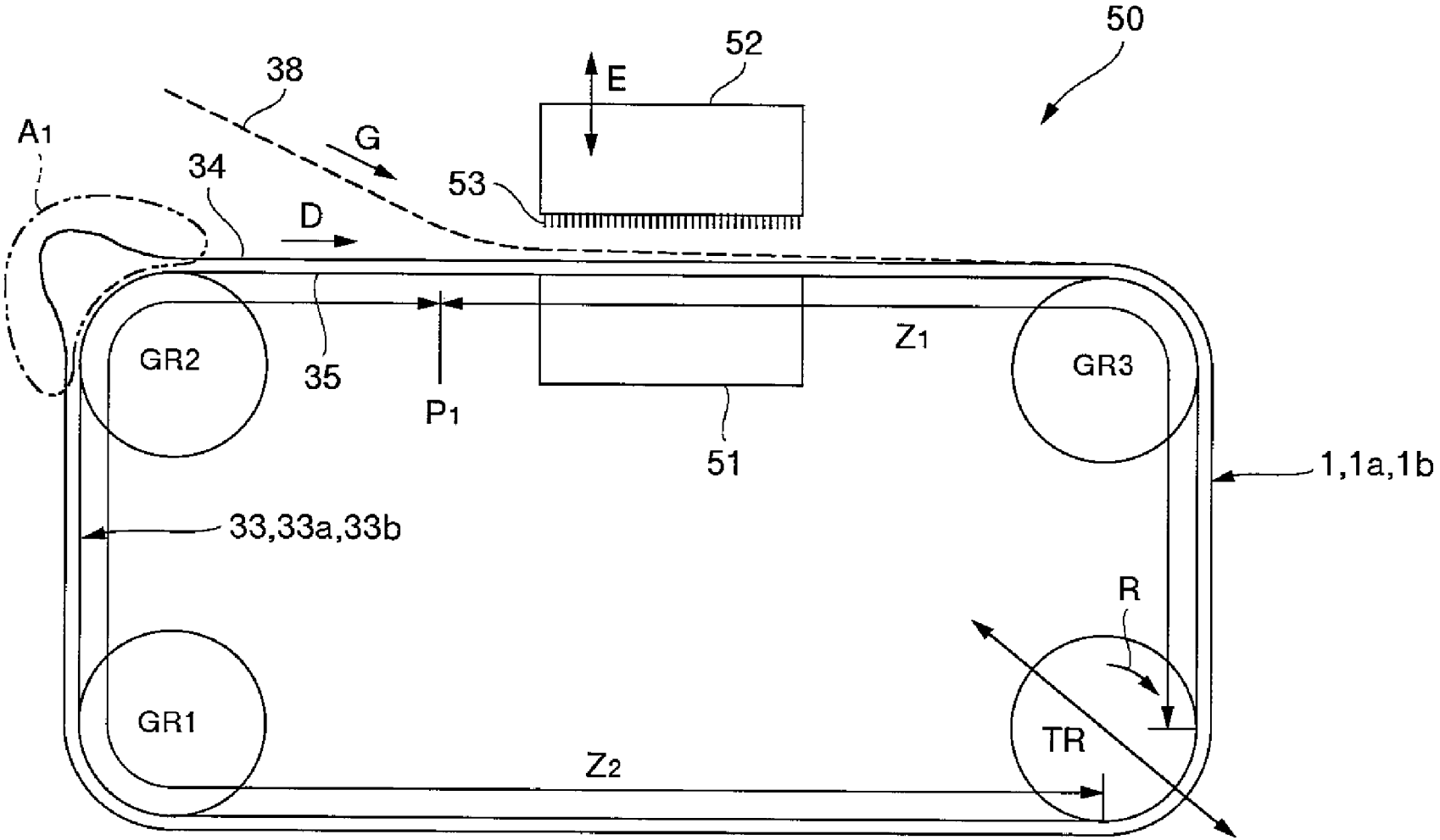

FIG. 7 is a view showing the manner in which the wet paper web transfer belt 1 (or the belt 1*a* or 1*b*) according to the present invention is manufactured by a needle machine 50. In FIG. 7, the basis weight of the first woven fabric 34 which is held in contact with the wet paper web-side batt layer 38 is smaller than the basis weight of the second woven fabric 35.

Figure 8:
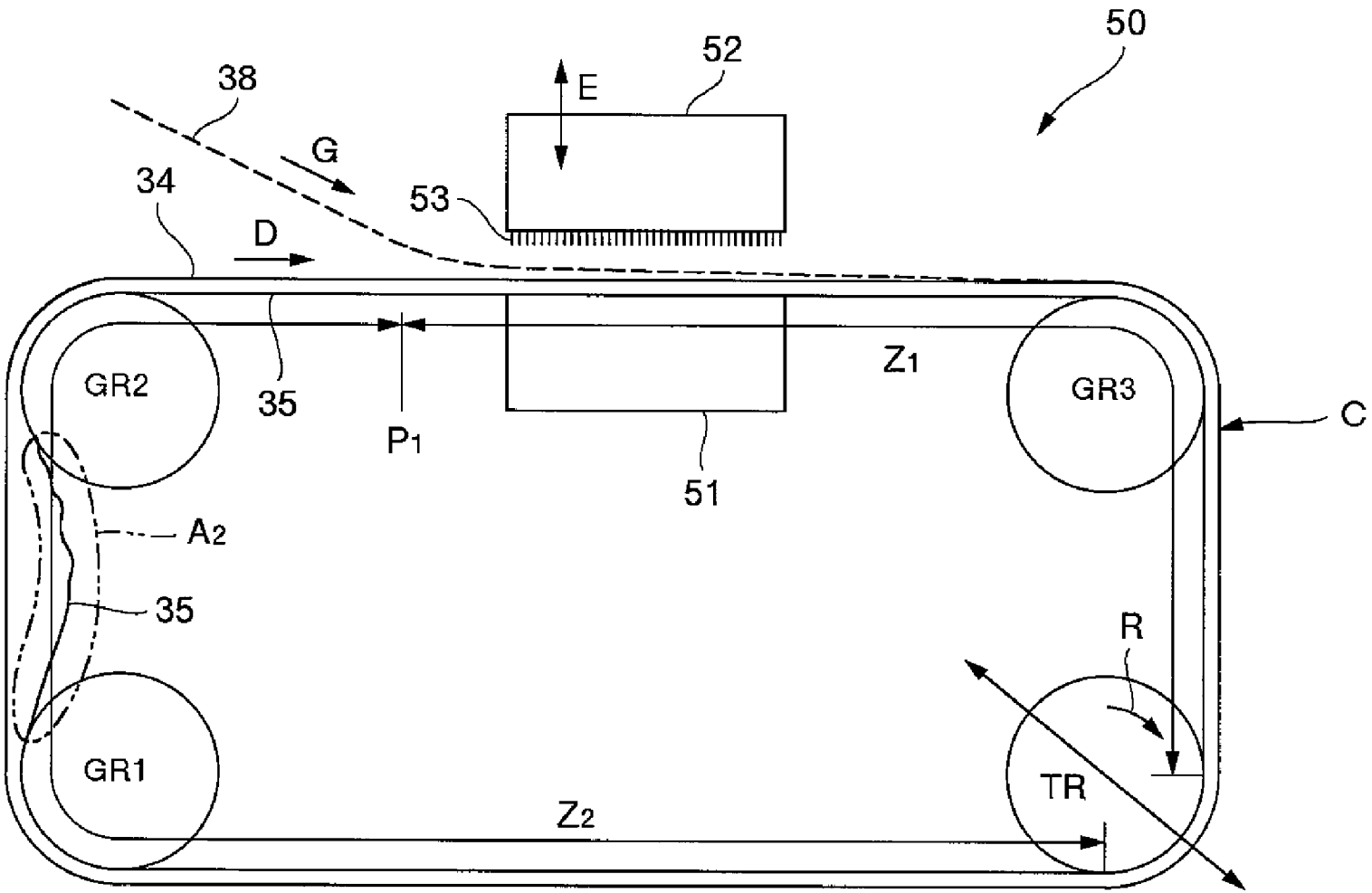

FIG. 8 is a view showing the manner in which a wet paper web transfer belt C according to comparative example 4 is manufactured by the needle machine 50. In FIG. 8, the basis weight of the first woven fabric 34 is greater than the basis weight of the second woven fabric 35.

As shown in FIG. 7, for manufacturing the belt 1 (or the belt 1*a* or 1*b*) or the wet paper web transfer belt C on the needle machine 50, the first woven fabric 34 and the second woven fabric 35 are stacked together into the base fabric 33 (or the base fabric 33*a* or 33*b*).

The base fabric 33 (or the base fabric 33*a* or 33*b*) of the stacked-layer structure is then caused to travel, around a plurality of guide rolls GR1, GR2, GR3 and a tension roll TR for adjusting the tension, as indicated by the allow D. At the same time, the wet paper web-side batt layer 38 is supplied in the direction indicated by the arrow G, and superposed onto the base fabric 33 (or the base fabric 33*a* or 33*b*).

As a result, the base fabric 33 (or the base fabric 33*a* or 33*b*) of the stacked-layer structure and the wet paper web-side batt layer 38 placed thereon pass between a bed plate 51 and a needle board 52. At this time, the needle board 52 moves back and forth as indicated by the arrow E to needle punch the wet paper web-side batt layer 38 with a number of needles 53 on the needle board 52.

In the needle machine 50, the tension roll TR is rotated in the direction indicated by the arrow R to transport the belt in the direction indicated by the arrow D. Generally, therefore, a zone from a position P1 in front of the bed plate 51 to the tension roll TR serves as a tensioning zone Z1 and a zone from the tension roll TR to the position P1 in front of the bed plate 51 serves as a slacking zone Z2.

Woven fabrics have a greater tensile modulus as their basis weight is greater. Therefore, the tension roll TR is tensed so that the first woven fabric 34 and the second woven fabric 35 undergo an elongation difference in the slacking zone Z2 due to the different moduli thereof. As a result, the first woven fabric 34 or the second woven fabric 35 slackens to the extent commensurate with the elongation difference.

In FIG. 7, the wet paper web-side batt layer 38 on the base fabric which is made up of the two stacked woven fabrics 34, 35 is schematically illustrated as being needle-punched by the needle board 52 as it moves up and down.

When the wet paper web-side batt layer 38 is needle-punched, the first woven fabric 34 which has the smaller basis weight slackens such that the first woven fabric 34 tends to project outwardly in a region A1 near the guide roll GR1 and the guide roll GR2. The first woven fabric 34 is prevented from slackening by positionally adjusting the guide roll GR2 to project outwardly by a distance corresponding to the slack in the first woven fabric 34.

In FIG. 8, the first woven fabric 34 and the second woven fabric 35 are stacked and the second woven fabric 35 which has the smaller basis weight is schematically illustrated as slackening. The second woven fabric 35 slackens such that the second woven fabric 35 tends to project inwardly in a region A2 near the guide roll GR1 and the guide roll GR2.

At this time, if the guide roll GR2 is positionally adjusted to project outwardly by a distance corresponding to the slack in the second woven fabric 35, then the slackening second woven fabric 35 tends to bite into the guide roll GR2, resulting in wrinkles formed in the second woven fabric 35.

To deal with the slack developed in the woven fabrics due to the different moduli of the first woven fabric 34 and the second woven fabric 35, the basis weight of the first woven fabric 34 is smaller than the basis weight of the second woven fabric 35 according to the present invention.

Comparative Example 4

1. Base Fabric:

The upper fabric (the wet paper web-side first woven fabric 34) was of a warp double weave structure (the warp yarns comprised nylon monofilament spun yarns and the weft yarns comprised nylon monofilament spun yarns), and had a basis weight of 400 g/m$^2$.

The lower fabric (the roll-side second woven fabric 35) was of a 1/1 plain weave structure (the warp yarns comprised nylon multifilament spun yarns and the weft yarns comprised PET single yarns), and had a basis weight of 200 g/m$^2$.

2. Batt Layer:

The wet paper web-side batt layer 38 was formed of rayon fibers of the hydrophilic fibrous body 30 by needle punching, and had a basis weight of 600 g/m$^2$. In the needle punching process, however, the lower fabric was slackened and wrinkled, and a wet paper web-side layer of good surface smoothness was not produced. The process was canceled subsequently.

The embodiments (including the inventive examples, the interpretation being also applicable wherever appropriate hereinafter) of the present invention have been described above. However, the present invention is not limited to the above embodiments, but various modifications and additions may be made within the scope of the present invention.

Identical reference characters denote identical or corresponding parts throughout views.

INDUSTRIAL APPLICABILITY

The wet paper web transfer belt according to the present invention is applicable to a belt for transferring a wet paper web in the press part of a closed-draw papermaking machine.

The invention claimed is:

1. A wet paper web transfer belt (1, 1*a*, 1*b*) for transferring a wet paper web (W) in a closed-draw papermaking machine (2), wherein the wet paper web transfer belt has a wet paper web-side layer (31), including a hydrophilic fibrous body (30) and disposed on a wet paper web (W) side, and a machine-side layer (32) disposed on a press roll (10) side, and a base fabric (33, 33*a*, 33*b*) is disposed in said belt, wherein said base fabric (33, 33*a*, 33*b*) comprises a first woven fabric (34) disposed on the wet paper web (W) side and a second woven fabric (35) disposed on the press roll (10) side, and said first woven fabric (34) and said second woven fabric (35) are stacked together;

said wet paper web-side layer (31) includes a wet paper web-side batt layer (38) made up of said hydrophilic fibrous body (30), so that said wet paper web-side batt layer (38) has high water absorbability and is impregnated with a high-polymer elastic body (39); and at least a portion of said hydrophilic fibrous body (30) is exposed on a surface (37) of said wet paper web-side layer (31), wherein either one or both of said first woven fabric (34) and said second woven fabric (35) include weft yarns (36) made of a material of low water absorptivity to provide dimensional stability in a widthwise direction of the web paper web transfer belt.

2. A wet paper web transfer belt (1, 1*a*, 1*b*) according to claim 1, wherein said weft yarns (36) of the woven fabrics are made of a material, of low water absorptivity, selected from the group consisting of polyester, aromatic polyamide, aromatic polyester and polyether ketone.

3. A wet paper web transfer belt (1, 1*a*, 1*b*) according to claim 1 or 2, wherein the basis weight of said first woven fabric (34) is smaller than the basis weight of said second woven fabric (35).

4. A wet paper web transfer belt (1) according to claim 3, wherein said first woven fabric (34) is of a plain weave and said second woven fabric (35) is of a double weave.

5. A wet paper web transfer belt (1*a*) according to claim 3, wherein said first woven fabric (34) is of a double weave and said second woven fabric (35) is of a triple weave.

6. A wet paper web transfer belt (1*b*) according to claim 3, wherein said first woven fabric (34) is of a plain weave and said second woven fabric (35) is of a triple weave.

7. A wet paper web transfer belt (1, 1*a*, 1*b*) according to claim 1, wherein said hydrophilic fibrous body (30) is formed in said wet paper web-side layer (31) by needle punching to improve a first function and a second function, said first function is a function to cause said wet paper web (W) to stick to said belt (1, 1*a*, 1*b*) and to transfer said wet paper web (W), and said second function is a function to allow said wet paper web (W) to be smoothly released therefrom for transferring the wet paper web (W) to a next process.

8. A wet paper web transfer belt according to claim 1, wherein said high-polymer elastic body (39) is made of a thermosetting resin selected from the group consisting of urethane, epoxy and acrylic, or a thermoplastic resin selected from the group consisting of polyamide, polyarylate and polyester.

9. A wet paper web transfer belt according to claim 1, wherein said hydrophilic fibrous body (30) is made of fibers selected from the group of hydrophilic fibers of nylon, vinylon, acetate, rayon, polynosic, cupra, cotton, hemp, silk and wool.

10. A wet paper web transfer belt according to claim 1, wherein a wet paper web-side batt layer (38) of said wet paper web-side layer (31) and a machine-side batt layer (40) of said machine-side layer (32) are made of rayon fibers or nylon fibers; and said hydrophilic fibrous body (30) included in said wet paper web-side layer (31) is made of fibers having surfaces chemically hydrophilized by a mercerizing process, a resinating process, a sputtering process based on the application of an ionizing radiation, or a glow discharge process.

11. A wet paper web transfer belt according to claim 1, wherein the official moisture regain of a fibrous body used as a machine-side batt layer (40) of said machine-side layer (32) is lower than the official moisture regain of said hydrophilic fibrous body (30) as a wet paper web-side batt layer (38) of said wet paper web-side layer (31) by 4% or more.

12. A wet paper web transfer belt according to claim 11, wherein said fibrous body used as a machine-side batt layer (40) is made of fibers selected from the group consisting of fibers of vinylidene, polyvinyl chloride, polyethylene, polypropylene, polyester, aromatic polyamide, polyurethane and acrylic.

* * * * *